US006005175A

United States Patent [19]

Johnson

[11] Patent Number: 6,005,175

[45] Date of Patent: Dec. 21, 1999

[54] GUITAR FULCRUM

[76] Inventor: Timothy Lee Johnson, 3773 Cherry Creek N. Dr., Denver, Colo. 80209

[21] Appl. No.: 09/056,830

[22] Filed: Apr. 7, 1998

[51] Int. Cl.[6] ..... G10D 3/00

[52] U.S. Cl. ..... 84/327; 84/328; 84/421; 84/453

[58] Field of Search ..... 84/327, 328, 329, 84/453, 421

[56] References Cited

U.S. PATENT DOCUMENTS 5,069,103 12/1991 Healy ..... 84/327
5,781,935 7/1998 Bassett et al. ..... 2/455

*Primary Examiner*—Robert E. Nappi
*Assistant Examiner*—Marlon Fletcher
*Attorney, Agent, or Firm*—Edwin H. Crabtree; Ramon L. Pizarro; Donald W. Margolis

[57] ABSTRACT

A guitar fulcrum is described herein which is used as an elbow rest for the elbow of a right or a left arm of a guitar player when playing a guitar. A standard guitar is designed for a person having an average height of 5 feet 10 inches. The fulcrum is designed for guitar players having a height greater than 5 feet 10 inches and/or with longer forearms and longer hands than people of this height. The guitar fulcrum allows for the proper placement of the player's fingers on the guitar strings adjacent a sweet spot above the sound hole of the guitar. Also, the guitar fulcrum positions the wrist lower than the elbow in a passive position. The passive position of the wrist relieves muscular tension produced in the forearm when having to hold up the hand in an active position. The guitar fulcrum includes an ergonomically designed elbow pad adapted for comfortably engaging a portion of the user's elbow. The elbow pad is pivotly mounted on upper ends of a pair of adjustable struts. The struts are used to adjust the height of the elbow pad above a hip of the body of the guitar. Lower ends of the two struts are attached to either suction cups or clamps used to secure the guitar fulcrum to the side of the guitar body. The fulcrum may also include an adjustment plate attached to the underside of the elbow pad and the upper ends of the strut. The adjustment plate allows for adjustment of the elbow pad on the guitar.

16 Claims, 2 Drawing Sheets

GUITAR FULCRUM

BACKGROUND OF THE INVENTION (a) Field of the Invention

This invention relates to an accessory for a musical string instrument and more particularly but not by way of limitation to a fulcrum for mounting on the side of a guitar, a banjo and like string instruments.

(b) Discussion of Prior Art

Heretofore, there have been a variety of different types of attachments for musical string instruments. In U.S. Pat. No. 491,755 to Le Valley, an arm rest and support for guitars is described. The support is designed to rest the right arm thereon and allow the left arm to be free to perform fingering without holding a portion of the weight of the guitar. There is no teaching in this patent of an adjustable fulcrum for holding a guitar player's lower arm in a passive position to prevent plodding during the playing of the musical instrument.

In U.S. Pat. No. 914,660 to Hartnett and U.S. Pat. No. 1,020,491 to Gough, a hand support and an arm rest for banjo players are described. These patents do not disclose the use of an adjustable fulcrum for a lower arm of a banjo player. In U.S. Pat. No. 1,753,006 to Haaf and U.S. Pat. No. 3,619,470 to Harris, a wrist support and a hand position device for violinists are described. Again these two patents do not teach the use of an adjustable fulcrum for attachment to the side of the musical string instrument.

In the study of a right hand technique related to the playing of a guitar, an important area of emphasis is often overlooked. This area of emphasis is fulcrum placement of the arm on the hip of the body of the guitar and active and passive resources related to the hand and the optimal effective use of the hand when playing the instrument. A Fulcrum is defined in Webster's New Collegiate Dictionary as a prop or a support used as a wedge about which a lever turns. More specifically, a fulcrum in regards to the right hand technique is the forearm placement on the side of the guitar at a specific point of contact. The forearm maintaining contact with the wood of the guitar which allows leverage and transference of weight. A metaphor would be a wheel of a wheelbarrow maintaining contact with a ground surface at a specific point. The wheel itself is the fulcrum while a handle on the wheelbarrow provides the range of motion.

Active resources are specifically defined as the degree of effort required by the muscles to overcome a certain resistance or gravity to maintain hand and arm positioning. In other words, active resources involves increasing tension in the muscles of the arm, wrist and hand. Passive resources are defined as using less muscular tension in the playing wrist and hand. The more the muscles of the entire arm can relax the more efficient and faster the muscle contractions and flexing in the playing fingers can occur.

A guitar pedagogy of Ricardo Iznaola describes two basic and general views on fulcrum positioning. A first view is described as the short arm approach. The placement of the fulcrum on the short arm approach is found approximately midway between the elbow and the wrist on the highest point on the side of the guitar. The point of contact becomes like a "teeter-totter" working one way and then the other. The bigger mechanism (i.e. back of the fulcrum towards the elbow, biceps, and triceps) acts upon the fulcrum in a specific manner. Since the majority of the weight rests behind the fulcrum towards the elbow, the effect on the hand is that the point of repose uses passive resources, or has a balanced state of the hand being in the air and not on the strings. Using the analogy of the teeter-totter, the elbow is the "bigger" child and thus creates a balanced passive positioning of the hand in the air above the strings. Since the natural point of repose for the hand is in the air, active resources are needed to bring it downwardly and into contact with the strings. Therefore, flexion of the wrist is required to bring the hand into contact with the strings and active resources are required to maintain hand positioning. Effort or flexion is also required to maintain contact with the strings, thus creating tension. This approach uses constant flexion and tension in the wrists which requires constant use of active resources. Although this approach is very useful, extreme caution must be given in regards to the degree of active resources used to maintain arm position and the dysfunctional tension that flexing produces in the wrist.

A second view on fulcrum positioning is termed the long arm approach. The fulcrum in the long arm approach is found approximately 1 inch from the elbow in the direction of the hand. The fulcrum on this approach again is found on the highest point on the side of the body of the guitar. A major difference in the long arm approach when compared to the short arm approach is that the long arm approach does not allow the teeter-totter like effect as in the short arm approach. Instead the fulcrum acts more like the fulcrum in the example of the wheelbarrow, thus projecting the weight towards the strings and allowing the point of repose, or relaxation and state of rest, to be on the strings instead of upwardly in the air. This approach uses more passive resources. The muscles of the entire right arm are allowed to more completely relax so the propitious weight upon the strings is achieved by the fingers using rest strokes and free strokes. More efficient manipulation of weight in playing and connecting stroke types is greatly increased if the muscles continue to draw upon their passive resources.

Another major difference is the degree of relaxation in the wrists. Since no effort or flexion is needed from the wrist in the long arm approach to maintain contact with the strings, the wrist is more relaxed, less flexed and greatly reduces the muscular tension in the wrists. In fact, because the wrist is so relaxed, a slight "listing" or tilting downward is created.

Therefore, a main issue when comparing the two techniques is where is the weight distribution of the playing hand/arm and how to control it. In the long arm approach, the weight of the hand goes forward and eventually to the strings using passive resources to maintain hand positioning. In the short arm approach, the weight rests backwards and active resources are involved to maintain handarm playing position. So one's musculature counteracts those tendencies for the measure of technical competence.

The ideal positioning of the right arm using the long arm approach is achieved when PIMA is placed on strings 4, 3, 2 and 1. PIMA being right hand finger symbols derived from Spanish. The letters "P" for pulgar or thumb, "I" for indicio or index finger, "M" for medio or middle finger and "A" for anular or ring finger. The right hand is placed on these strings in respective order towards the portion of the sound hole closest to the bridge of the guitar. This portion of the sound hole called herein the "sweet spot". Playing the strings closest to the "sweet spot" produces a "standard" tone used by classical guitarist. It also provides for increased volume clarity and projection of the sounds from the guitar. Ideally the fulcrum will then be found at the widest portion of the hip of the guitar and 1 inch from the elbow towards the wrist. The shoulders of the musician will be horizontal and parallel with the floor so the elbow rests at the long arm fulcrum and there is a gently slope downward from the elbow-forearm-hand to a normal free stroke positioning of PIMA on strings 4, 3, 2 and 1, in respective order over the sweet spot. This is the ideal positioning, or poised positioning of the limb in regards to the long arm approach. The "ideal" positioning exists for those players who are approximately 5'10". A classical guitar is designed more readily to accommodate players of that size. For over a hundred years, this has been the standard size of the classical guitar.

When examining a "normal" hand/arm position for people who have bigger and/or longer forearms and hands and are above the approximate height standard of 5 feet 10 inches problems occur. In fact, an extreme height difference of 6 feet 3 inches may be used to illustrate "normal" free stroke positioning for large and tall players. An example might be that typically someone who is 5 feet 10 inches tall will typically have a forearm length from elbow to wrist in a range of 9 to 10 inches plus 3 inches from the wrist to the first knuckles in the hand. A player who is taller than 6 feet will typically have a forearm length from elbow to wrist in a range of 11 to 12 inches plus 3 to 4 inches from the wrist to the first knuckles in the hand. Also, players may have longer hands and fingers which will influence the proper positioning of the fingers on the strings next to the "sweet spot" of the sound hole.

A player who is 6 feet 3 inches who may have long hands and fingers and who chooses to employ the long arm technique encounters many difficulties when using this approach. For example, using the previous guidelines for placement of the fulcrum on the hip of the body of the guitar places the hand above the sound hole next to the frets and not next to the "standard" position or the "sweet spot". The "sweet spot" being above a lower portion of the sound hole. Therefore, this is unacceptable positioning for the playing hand. Standard guitar tone colors, clarity and volume are achieved when the fingers are positioned on the strings over the "sweet spot" of the sound hole.

In order for a player, whose stature is 6 feet 3 inches, to achieve proper hand positioning over the sound hole several concessions are made. First the fulcrum must be lowered from the hip of the body of the guitar. The resulting action is a change in the angle of the forearm in relation to the strings. The shoulder is also lowered from the horizontal to accommodate this new position resulting in an imbalance of "poise" or parallelism of the shoulders. The main problem is that because of this lowered elbow positioning a bigger forearm mechanism is no longer supporting a smaller hand mechanism. In other words, instead of having balanced "poised" shoulders, and having the direction of the limbs gravitate steadily downwards to the strings, the wrist becomes higher than the elbow. This increases the amount of effort and muscular tension in the forearm and in turn the fingers thereby decreasing flexibility of the fingers and decreasing muscle fiber contraction and speed and once again active resources are used to maintain this positioning.

Another problem encountered in this positioning of the elbow downwardly from the hip of the body of the guitar is that all the energy that is stored in the forearm tendons and fingers when applied to the strings are transferred onto the strings. In other words "bigger" people or people with long forearms and long hands and fingers tend to "plod" on the guitar in this position. This is a direct result of holding too much energy and muscular tension in the forearm and fingers and transferring the energy to the string whenever a finger stroke type is produced. An easier to understand analogy can be applied to the piano. It would be similar to a pianist who had 5lb. weights attached to the top of his or her wrists. Every time a key would be struck, the weight would be transferred to the key producing a louder "plodding" sound.

Second, if a player continues to use the highest point or the hips on the body of the guitar as the fulcrum for the long arm approach, the only way of playing "over" the sound hole is to create an extreme angle between the hand and the forearm. This positioning creates tension in the wrist and can be very painful.

Since the classical guitar size has been standardized for over 100 years, bigger classical guitars are unavailable for the taller player or the player with long arms and hands. They simply are not mass-produced. Until now, the only solution for the tall player or the player with long forearms and hands has been to employ the short arm approach using active resources, deal with the problems created by the long arm approach, or commission a guitar luthier to customize a guitar to that player's special fulcrum. Large individuals adjust their stature/physique to the guitar. The ideal solution is that the guitar should rise to meet the player in the long arm approach. On anyone above 5 feet 10 inches, this fulcrum is found at a different height adjustment above the body of the guitar. Since custom guitars are out of the price range for the average player or beginner, the only solution in the past has been for the large guitarist to adapt to the guitar. Since classical guitarists tend to be traditionalists, the larger guitar option is usually dismissed.

Another major problem large and tall individuals and players with long forearms and long hands and fingers encounter with the classical guitar in the long arm approach is being able to distinguish and to develop an awareness of the minimal amounts of effort needed from the right hand fingers to properly play the guitar. If one is constantly holding muscular tension in the forearm tendons, which transfers to the fingers, a more relaxed "poised" limb is impossible to achieve mainly due to this held tension in the limb. Achieving a balanced sense of "poise" for the body is the answer for large framed individuals who wish to pursue virtuositic levels of playing. The solution is to adjust the fulcrum on these individuals, and again the height adjustment from the hips of the body of the guitar fulcrum is different for every individual's height.

SUMMARY OF THE INVENTION

In view of the foregoing, it is a primary object of the present invention to counteract the need for one's musculature effort to maintain a straight alignment in the arm and wrist in the short arm approach playing position described above.

Another primary object of the invention is that the subject guitar fulcrum allows you to hold the playing hand, either the right hand or the left hand, in a passive position when compared to what a player would have to do actively without a fulcrum support. Accordingly "plodding" is avoided and a player's musical ability is greatly improved. The guitar fulcrum allows for adjusting different lengths of forearms, hands and fingers of players of different stature so that the fingers are placed on the strings and over the "sweet spot" of the sound hole.

Yet another object of the invention is to eliminate the need for luthiers to make special guitars for large and/or tall individuals. The invention allows for height adjustments above the hip of the body of the guitar to find the ideal fulcrum on each guitar player. The guitar fulcrum is adjustable to the physical stature of the player. The proper height adjustment of the guitar fulcrum may be accomplished with the aid of a large mirror or the help of a teacher as a guide.

Still another object of the fulcrum is the entire weight of the player's shoulders, triceps, biceps and elbow is supported thereon thereby allowing the arm and hand to relax and achieve a balanced state of poise when playing the guitar. Stress on the guitar is reduced and marks, sweat and oil on the finish of the guitar are avoided. Since the elbow of the player is positioned "off" the hip of the guitar, the guitar is allowed to resonate more freely with the arm not absorbing the sound. This advantage provides for increased volume, clarity and projection of sounds.

A further object of the invention is through the use of the subject invention, a greater awareness of poise is achieved. Playing posture is improved and one is able to allow the spine to be positioned straighter which in turn reduces tension and backaches.

Another object of the invention is the elbow pad is ergonomically designed so that the elbow sits on the elbow pad without pinching tendons in the arm due to the rounded edge of the elbow pad.

The invention is aesthetically pleasing and is partially hidden during the playing of the guitar. The guitar fulcrum can be used by players growing between guitar sizes. For example, going from a ½ size to a ¾ size to a full size guitar. The invention eliminates the need and added expense of buying an enlarged guitar. Therefore the "traditional" style and size of a classical guitar remains the same.

These and other objects of the present invention will become apparent to those familiar with guitars, guitar accessories and guitar playing from the following detailed description, showing novel construction, combination, and elements as described herein, and more particularly defined by the appended claims, it being understood that changes in the embodiments to the disclosed invention are meant to be included as coming within the scope of the claims, except as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
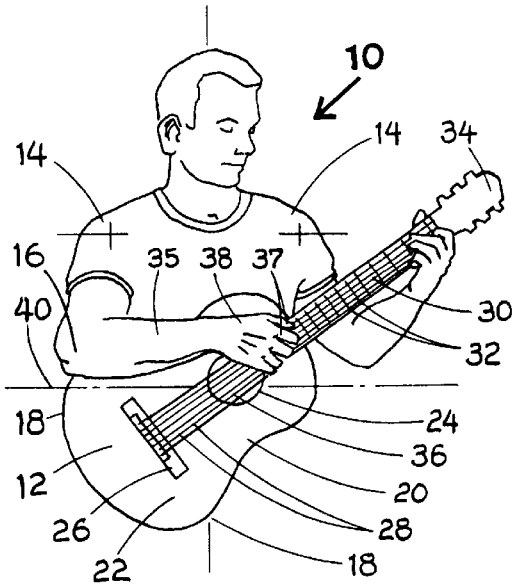
FIG. 1 is a front view of guitar player with guitar using the long arm technique. The player is shown with his shoulder positioned horizontally and his elbow resting against the hip of the body of the guitar. Note the player has a longer forearm than a player having a height in a range of 5 feet 10 inches. In this drawing, because of the longer forearm, the player's fingers are positioned not above the sweet spot next to the sound hole but next to the frets of the guitar.

In FIG. 1, a front view of a guitar player, having general reference numeral 10, is shown with a guitar 12. The player 10 is using a long arm technique as described above. The short arm technique described above is not shown in the drawings. The player 10 has shoulders 14 properly positioned horizontally with his elbow 16 resting against a hip 18 of a body 20 of the guitar 12. The hip 18 or hips 18 being defined as the widest portion of the body 20 of the guitar 12.

The guitar 12 also includes a sound board 22, a sound hole 24, a bridge 26, strings 28, a neck 30, frets 32 and a head 34. The guitar 12 described herein is a typical classical guitar, but it should be kept in mind that the subject invention can be used with various sizes and types of guitars along with similar stringed instruments.

Note the player 10, shown in FIG. 1, has a longer forearm 35 than a player having a height in a range of 5 feet 10 inches with a forearm in a range of 9 to 10 inches. In this drawing, because of the longer forearm 35, which might be in a range of 11 to 12 inches, the player's fingers 37 are positioned "not" above a sweet spot 36, which is an area in the lower portion of the sound hole 24, but next to the lower frets 32 of the guitar 12. Obviously, the players musical ability is impaired by this improper hand position on the guitar 12. While the discussion herein discusses a right handed guitar player, it should be kept in mind that the invention described certainly applies to left handed guitar players.

Figure 2:
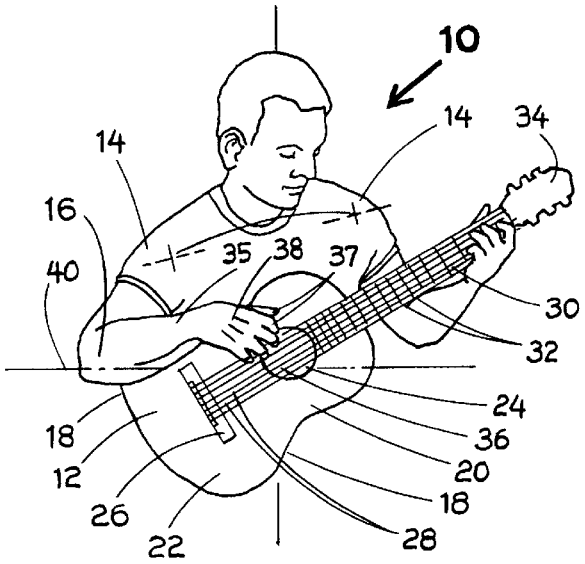
FIG. 2 is similar to FIG. 1 but with the player compensating for the length of his forearm and moving the elbow downwardly from the hip of the body of the guitar. The players shoulders are now sloping downwardly and the playing hand has been into an active position with the fingers adjacent the sweet spot of the sound hole.

In FIG. 2, the player 10 is shown compensating for the increased length of his forearm 35 by moving the elbow 16 downwardly from the hip 18 of the body 20 of the guitar 12. The player's shoulders 14 in turn are now sloping downwardly and the player's playing hand 38 has been into an active position above the elbow 16 with the fingers 37 adjacent the sweet spot 36 of the sound hole 24. In this drawing, the playing hand 38 is shown positioned above a horizontal line 40 which is drawn through the sweet spot 36 of the guitar 12. In this example, gravity is working against the forearm 35 and hand 38 of the player 10. Note also the elbow 16 is below the horizontal line 40. As mentioned above, when the playing hand 38 is moved above the elbow 16 as shown, stress and tension is placed on the forearm, hand and fingers and "plodding" occurs during the playing of a musical piece due to the effect of gravity.

Figure 3:
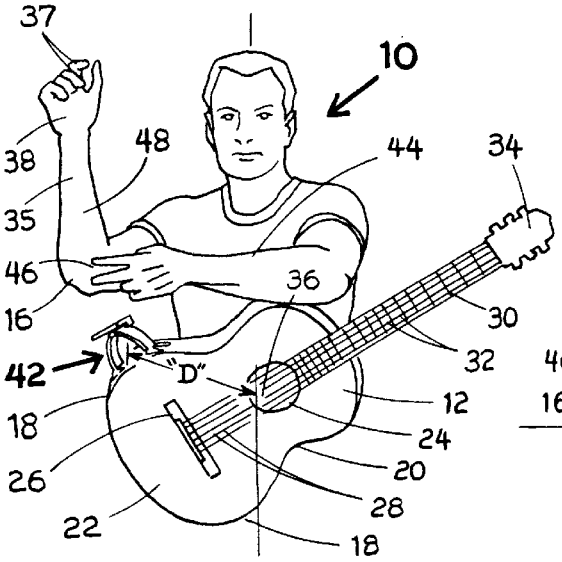
FIG. 3 is a front view of the guitar player with the subject invention mounted on the hip of the body of the guitar. The player is shown with his left arm pointing to a fulcrum point on the elbow of the player's right arm.

In FIG. 3, a front view of the guitar player 10 is shown with the subject guitar fulcrum shown mounted on the hip 18 of the body 20 of the guitar 12. The guitar fulcrum is illustrated having a general reference numeral 42. The player 10 is shown with his left arm 44 pointing to a fulcrum point 46 on the elbow 16 of the player's right arm 48. The fulcrum point 46 of the elbow 16 is placed on the top of the guitar fulcrum 42 when in use.

Note in FIG. 3, a diagonal line "D" is shown from the widest portion of the hip 18 to the bottom of the sound hole 24 and next to the sweet spot 36. The line "D" typically has a length of 9 to 10 inches for a standard classical guitar 12. As mentioned above, this distance is appropriate for a player of average height and having a forearm with a length in a range of 9 to 10 inches with the length from the wrist to the middle knuckle of the hand being in of 2½ to 3 inches. This distance places the players fingers 37 next to the sweet spot 36. Obviously, when a player's forearm is longer than the range of 9 to 10 inches with a longer elbow, longer hand and longer fingers, the need for the subject invention arises.

Figure 4:
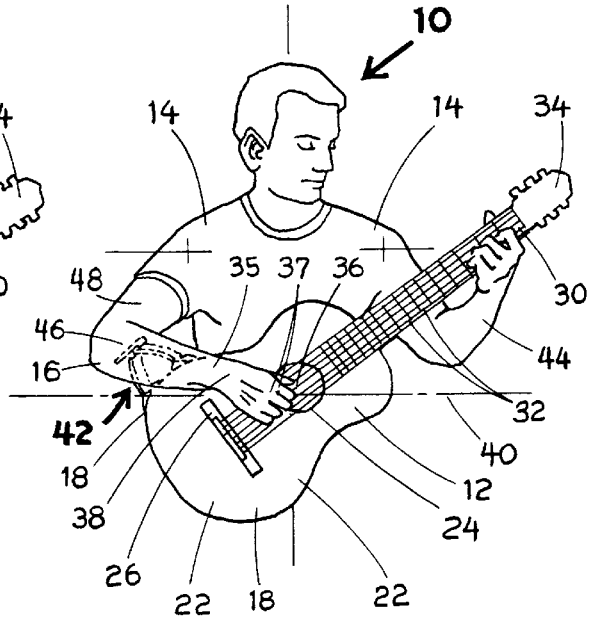
FIG. 4 is a front view of the guitar player with the elbow of the right arm resting on the elbow pad of the subject guitar fulcrum and the player's fingers in a passive position next to the sweet spot of the sound hole.

In FIG. 4, a front view of the guitar player 10 is shown with the fulcrum point 46 of the elbow 16 of the right arm 48 resting on top of an elbow pad 50 of the guitar fulcrum 46. The elbow pad 50 is shown in greater detail in FIGS. 5 and 6. In this drawing, the player's fingers 37 are in a passive position next to the sweet spot 36 of the sound hole 24. The fingers 37 and playing hand 38 are disposed below the elbow 16 allowing the forearm 35 and hand 38 to relax and achieve a balanced state of poise. Also note with the use of the guitar fulcrum 46, the player's shoulders 14 are now positioned horizontally with proper upright body posture.

Figure 5:
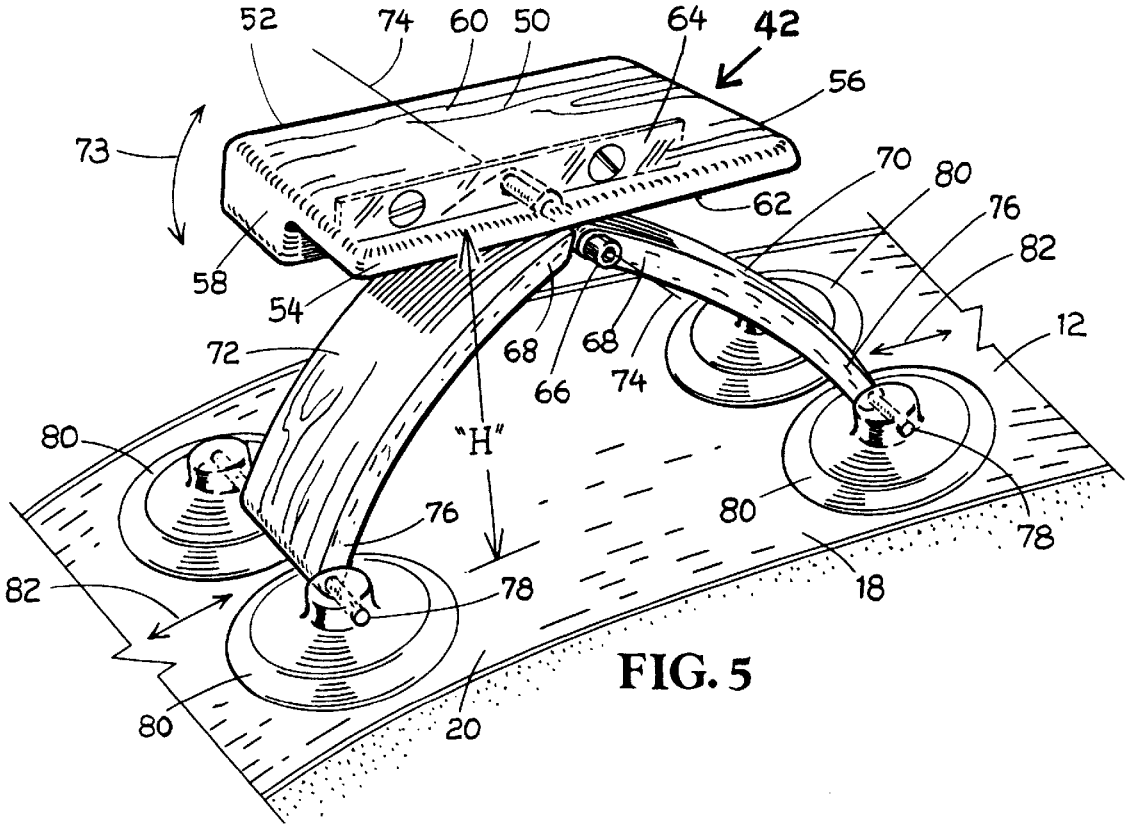
FIG. 5 is a perspective view of the guitar fulcrum with suction cups used for attaching the fulcrum to the hip of the body of the guitar.

In FIG. 5, a perspective view of the detailed structure of the subject guitar fulcrum 42 is shown. The elbow pad 50 is designed with ergonomics in mind and the pad 50 includes a rounded first side 52 to prevent the pinching of tendons in the elbow 16. The pad 50 may take on various geometric configurations with the first side 52 rounded to conform to contour and shape of the elbow 16.

The elbow pad 50 also a rounded second side 54, a first end 56, a second end 58, a smooth planer top surface 60 for receiving the elbow thereon and a bottom surface 62. The bottom surface 62 includes an attachment plate 64, shown in dotted lines, which is pivotly attached to a hinge pin 66. The hinge pin 66 is received through the upper ends 68 of a first adjustable strut 70 and a second adjustable strut 72. Note, the elbow pad 50 is free to pivot, as indicated by arrow 73, about an axis 74 through the center of the length of the hinge pin 66. The pivoting of the elbow 50 on top of the struts 70 and 72 allows for adapting the elbow pad 50 to the contour of the inside of the elbow 16 for ease and for a comfort fit.

Lower ends 76 of the two struts 70 and 72 are pivotly mounted on suction cup pivot pins 78. The two pivot pins 78 are each attached to a pair of suction cups 80. The suction cups 80 are used to secure the guitar fulcrum 42 to one of the hips 18 of the body 20 of the guitar 12.

It should be noted that when mounting the guitar fulcrum 42 on the guitar 12, by pivoting the struts 70 and 72 on the hinge pin 66 and the pivot pins 78 inwardly toward each other, a height "H" can be adjusted upwardly. The height "H" being a distance between the top surface 60 of the elbow pad 50 and the hip 18 of the guitar 12. By raising the height "H" of the elbow pad 50, the distance from the elbow 16 to the sweet spot 36 is increased. Obviously, for tall and large players with long forearms and long hands and fingers, the height "H" should be increased until the fingers are properly placed next to the lower portion of the sound hole 24. The increasing and decreasing of the height "H" above the hip 18 for different stature of players is indicated by arrows 82.

Figure 6:
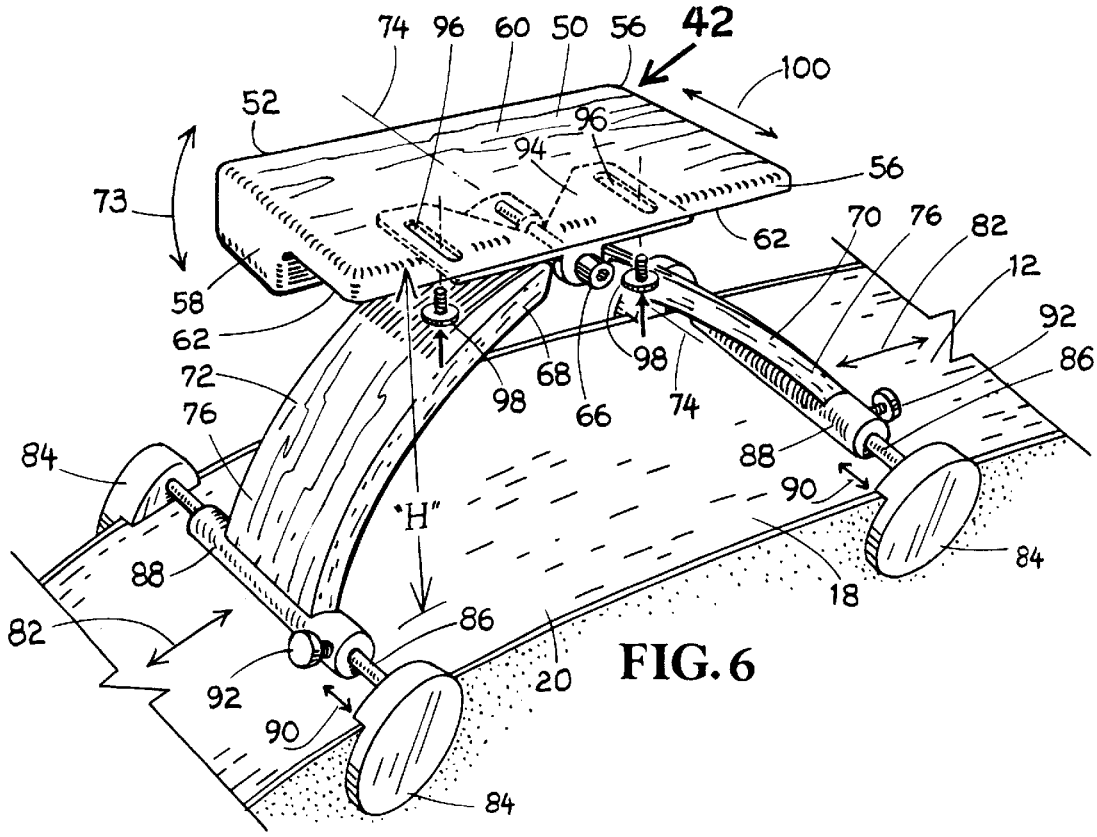
FIG. 6 is another perspective view of the guitar fulcrum with adjustable clamps used for securing the fulcrum to the hip of the body of the guitar.

In FIG. 6, another perspective view of the guitar fulcrum 42 is shown with adjustable clamps 84. Two of the clamps 84 are attached to clamp pivot pins 86 which are slidably received in two clamp housings 88. The housings 88 are attached to the lower ends 76 of the struts 70 and 72. Because the width of the body 20 of the guitar 12 may vary from manufacture to manufacture, the clamps 84 can be adjusted by sliding the pivot pins 86 in and out, as indicated by arrows 90. When the clamps 84 are in a proper positions, as shown in the drawings, for engaging the sides of the body 20 of the guitar 12, clamp housing screws 92 can be used to tighten the pivot pins 86 in the housings 88 thereby securing the guitar fulcrum 42 to the hip 18 of the guitar 12.

Also shown in this drawing, is an adjustable attachment plate 94, shown in dotted lines, with a pair of elongated openings 96 therein for receiving screws 98 therethrough and into the bottom surface 62 of the elbow pad 50. The adjustable attachment plate 94 is pivotly mounted on the hinge pin 66 and is used to adjust the elbow pad 50 fore and aft, as indicated by arrow 100, on top of the struts 70 and 72.

This means for adjusting the elbow pad 50 is but another way of helping a guitar player properly adjust the guitar fulcrum 42 to his or her elbow.

While the above drawings illustrate two ways of securing the guitar fulcrum 42 to the hip 18 of the guitar 12 along with ways of adjusting the elbow pad 50 thereon, it can be appreciated that there are various ways of attaching and adjusting the subject invention to the guitar without departing from the spirit and scope of the invention.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A guitar fulcrum for releasably mounting on a hip of a body of a guitar, the guitar fulcrum receiving a guitar player's elbow thereon and allowing for the proper placement of a player's fingers on guitar strings adjacent a sweet spot above a sound hole in the guitar, the guitar fulcrum comprising:

an ergonomically designed elbow pad adapted for comfortably engaging a portion of the player's elbow; and means for holding said elbow pad above the body of the guitar, said means for holding adapted for attachment to the hip of the body of the guitar.

2. The guitar fulcrum as described in claim 1 wherein said means for holding is at least one strut having an upper end attached to a bottom surface of said elbow pad.

3. The guitar fulcrum as described in claim 2 wherein said elbow pad is pivotly mounted on the upper end of said strut.

4. The guitar fulcrum as described in claim 2 wherein a lower end of said strut is releasably attached to the hip of the body of the guitar.

5. The guitar fulcrum as described in claim 1 wherein said means for holding said elbow pad is adjustable on said elbow pad for raising and lower said elbow pad above the hip of the body of the guitar.

6. A guitar fulcrum for releasably mounting on a body of a guitar, the guitar fulcrum receiving a guitar player's elbow thereon and allowing for the proper placement of a player's fingers on guitar strings adjacent a sweet spot above a sound hole in the guitar, the guitar fulcrum comprising:

an ergonomically designed elbow pad having a smooth planer top surface and a bottom surface, said elbow pad adapted for comfortably engaging a portion of the player's elbow; and at least one strut, an upper end of said strut attached to the bottom surface of said elbow pad, a lower end of said strut attached to the body of the guitar.

7. The guitar fulcrum as described in claim 6 wherein said elbow pad is pivotly mounted on the upper end of said strut.

8. The guitar fulcrum as described in claim 6 wherein said elbow pad is adjustably mounted fore and aft on the upper end of said strut.

9. The guitar fulcrum as described in claim 6 wherein the lower end of said strut is pivotly mounted on the body of the guitar for raising and lowering the elbow pad above the hip of the body of the guitar.

10. The guitar fulcrum as described in claim 6 wherein the lower end of said strut is releasably attached to the body of the guitar.

11. A guitar fulcrum for releasably mounting on a hip of a body of a guitar, the guitar fulcrum receiving a guitar player's elbow thereon and allowing for the proper placement of a player's fingers on guitar strings adjacent a sweet spot above a sound hole in the guitar, the guitar fulcrum comprising:

an ergonomically designed elbow pad having a smooth planer top surface and a bottom surface, said elbow pad adapted for comfortably engaging a portion of the player's elbow; and a first strut and a second strut, an upper end of said struts pivotly mounted on a hinge pin, said hinge pin attached to the bottom surface of said elbow pad; a lower end of said struts releasably attached to the hip of the body of the guitar.

12. The guitar fulcrum as described in claim 11 wherein said elbow pad is adjustably mounted fore and aft on the upper end of said struts.

13. The guitar fulcrum as described in claim 11 wherein the lower end of said struts is pivotly mounted on the hip of the body of the guitar for raising and lowering the elbow pad above the hip of the body of the guitar.

14. The guitar fulcrum as described in claim 11 wherein the lower end of said struts is releasably attached to the hip of the body of the guitar.

15. The guitar fulcrum as described in claim 11 wherein the lower ends of said struts are attached to suction cups, said suction cups releasably attached to the hip of the body of the guitar.

16. The guitar fulcrum as described in claim 11 wherein the lower ends of said struts are attached to clamps, said clamps releasably attached to opposite sides of the hip of the body of the guitar.

* * * * *